US009897947B2

(12) United States Patent
Kanatani et al.

(10) Patent No.: US 9,897,947 B2
(45) Date of Patent: Feb. 20, 2018

(54) IMAGE FORMING APPARATUS EXECUTING CHARGE REMOVAL FOR PHOTOCONDUCTOR THEREOF AND CONTROL METHOD FOR SAME

(71) Applicants: Yuka Kanatani, Kanagawa (JP); Yuushi Hirayama, Shizuoka (JP); Kazufumi Kimura, Kanagawa (JP); Ryota Kidera, Tokyo (JP); Masanori Moro, Kanagawa (JP); Yoshihiro Fujiwara, Kanagawa (JP); Hideyasu Seki, Chiba (JP)

(72) Inventors: Yuka Kanatani, Kanagawa (JP); Yuushi Hirayama, Shizuoka (JP); Kazufumi Kimura, Kanagawa (JP); Ryota Kidera, Tokyo (JP); Masanori Moro, Kanagawa (JP); Yoshihiro Fujiwara, Kanagawa (JP); Hideyasu Seki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/264,227

(22) Filed: Sep. 13, 2016

(65) Prior Publication Data

US 2017/0075264 A1 Mar. 16, 2017

(30) Foreign Application Priority Data

Sep. 15, 2015 (JP) ..... 2015-181594

(51) Int. Cl.
*G03G 15/02* (2006.01)
*G03G 15/16* (2006.01)
(Continued)

(52) U.S. Cl.
CPC ..... *G03G 15/1665* (2013.01); *G03G 15/0266* (2013.01); *G03G 21/06* (2013.01); *G03G 21/08* (2013.01)

(58) Field of Classification Search
None
See application file for complete search history.

(56) References Cited

U.S. PATENT DOCUMENTS 5,164,779 A * 11/1992 Araya ..... G03G 21/06 361/225
5,585,894 A * 12/1996 Araya ..... G03G 21/06 399/114
(Continued)

FOREIGN PATENT DOCUMENTS

EP 0 280 542 A2 8/1988
EP 0 297 911 A2 1/1989
(Continued)

OTHER PUBLICATIONS

Extended European Search Report dated Jan. 25, 2017 in European Patent Application No. 16187226.2.

*Primary Examiner* — Sevan A Aydin
(74) *Attorney, Agent, or Firm* — Oblon, McClelland, Maier & Neustadt, L.L.P.

(57) ABSTRACT

An image forming apparatus includes a photoconductor on which an electrostatic latent image is formed by irradiation of the photoconductor with light, a charger, a developing device, a transfer device, a charge removal execution determiner, and a power supply controller. The charger receives a superimposed voltage of a DC voltage and an AC voltage to charge the photoconductor. The developing device develops the electrostatic latent image on the photoconductor into a toner image. The transfer device transfers the developed toner image to a recording medium. The charge removal execution determiner issues a charge removal command
(Continued)

when a flow of electric charge from the transfer device into the photoconductor has occurred in an image forming outputting operation. The power supply controller applies only the AC voltage to the charger for a predetermined period in a state in which the photoconductor is rotated, when the charge removal command is issued.

9 Claims, 8 Drawing Sheets

(51) Int. Cl.
*G03G 21/06* (2006.01)
*G03G 21/08* (2006.01)

(56) References Cited

U.S. PATENT DOCUMENTS 5,600,413 A * 2/1997 Kimura ..... G03G 15/0216 399/169
5,612,772 A * 3/1997 Enomoto ..... B82Y 15/00 399/101
5,626,997 A 5/1997 Mashimo et al.
2002/0021910 A1* 2/2002 Hori ..... G03G 15/168 399/38
2003/0161660 A1* 8/2003 Takahashi ..... G03G 15/0216 399/149
2005/0100375 A1 5/2005 Naruse et al.
2007/0003315 A1* 1/2007 Iwai ..... G03G 15/0258 399/100
2009/0110413 A1 4/2009 Takeuchi et al.
2009/0190960 A1 7/2009 Hirayama et al.
2009/0202263 A1 8/2009 Yoshida et al.
2009/0263150 A1 10/2009 Fujimori et al.
2009/0279907 A1 11/2009 Tanaka et al.
2009/0324267 A1 12/2009 Yoshida et al.
2010/0092188 A1 4/2010 Hirayama et al.
2010/0221026 A1* 9/2010 Komatsu ..... G03G 15/0266 399/50
2010/0278549 A1 11/2010 Ishibashi et al.
2011/0110689 A1 5/2011 Hirayama et al.
2012/0308260 A1* 12/2012 Kabata ..... G03G 21/0094 399/346
2012/0315056 A1 12/2012 Muroi et al.
2013/0004207 A1 1/2013 Hirayama et al.
2015/0130886 A1* 5/2015 Yaguchi ..... G03G 15/043 347/224
2015/0234316 A1 8/2015 Kanaya et al.

FOREIGN PATENT DOCUMENTS

EP 0 475 423 A2 3/1992
JP 4-009883 1/1992
JP 2000010364 A * 1/2000
JP 2007-156314 6/2007
JP 2009-251384 10/2009

* cited by examiner

IMAGE FORMING APPARATUS EXECUTING CHARGE REMOVAL FOR PHOTOCONDUCTOR THEREOF AND CONTROL METHOD FOR SAME

CROSS-REFERENCE TO RELATED APPLICATION

This patent application is based on and claims priority pursuant to 35 U.S.C. § 119 to Japanese Patent Application No. 2015-181594, filed on Sep. 15, 2015, in the Japan Patent Office, the entire disclosure of which is hereby incorporated by reference herein.

BACKGROUND

Technical Field

Exemplary aspects of the present disclosure relate to an image forming apparatus and a control method for the image forming apparatus.

Related Art

In recent years, digitization of information tends to be promoted, and image processing apparatuses such as printers and facsimile machines used for output of digitized information and scanners used for digitization of documents become indispensable. In most cases, such image processing apparatuses have an image capturing function, an image forming function, and a communication function to serve as a multi-function peripheral capable of being used as a printer, a facsimile machine, a scanner, and a copier.

Among such image processing apparatuses, an electrophotographic image forming apparatus that is one example of image forming apparatuses used for output of digitized documents is widely used. The electrophotographic image forming apparatus irradiates a photoconductor thereof with light to form an electrostatic latent image on the photoconductor, develops the electrostatic latent image with developer such as toner to form a toner image on the photoconductor, transfers the toner image to a sheet using a transfer device, and outputs the sheet with the transferred image.

After transferring the toner image developed on the photoconductor, the electrophotographic image forming apparatus removes residual electric charge from the photoconductor. The electric charge remaining on the photoconductor can be removed by irradiating a surface of the photoconductor with light (hereinafter called "charge removal irradiation") or discharging the surface of the photoconductor (hereinafter called "charge removal discharge").

SUMMARY

In at least one embodiment of this disclosure, there is provided an improved image forming apparatus that includes a photoconductor on which an electrostatic latent image is formed by irradiation of the photoconductor with light, charger, a developing device, a transfer device, a charge removal execution determiner, and a power supply controller. The charger receives a superimposed voltage of a direct current voltage and an alternating current voltage to charge the photoconductor. The developing device develops the electrostatic latent image formed on the photoconductor into a toner image. The transfer device transfers the toner image developed by the developing device to a recording medium. The charge removal execution determiner issues a charge removal command when a flow of electric charge from the transfer device into the photoconductor has occurred in an image forming outputting operation. The power supply controller applies only the alternating current voltage to the charger for a predetermined period in a state in which the photoconductor is rotated, when the charge removal execution determiner issues the charge removal command.

In at least one embodiment of this disclosure, there is provided an improved method for controlling an image forming apparatus. The control method includes charging a photoconductor disposed in the image forming apparatus and on which an electrostatic latent image is formed by irradiation of the photoconductor with light using a charger that receives superimposed voltage of a direct current voltage and an alternating current voltage, developing the electrostatic latent image formed on the photoconductor into a toner image using a developing device, transferring the toner image developed by the developing device to a recording medium using a transfer device, issuing an charge removal command when a flow of electric charge from the transfer device into the photoconductor has occurred in an image forming outputting operation, applying only the alternating current voltage to the charger for a predetermined period in a state in which the photoconductor is rotated when the charge removal execution determiner issues the charge removal command.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
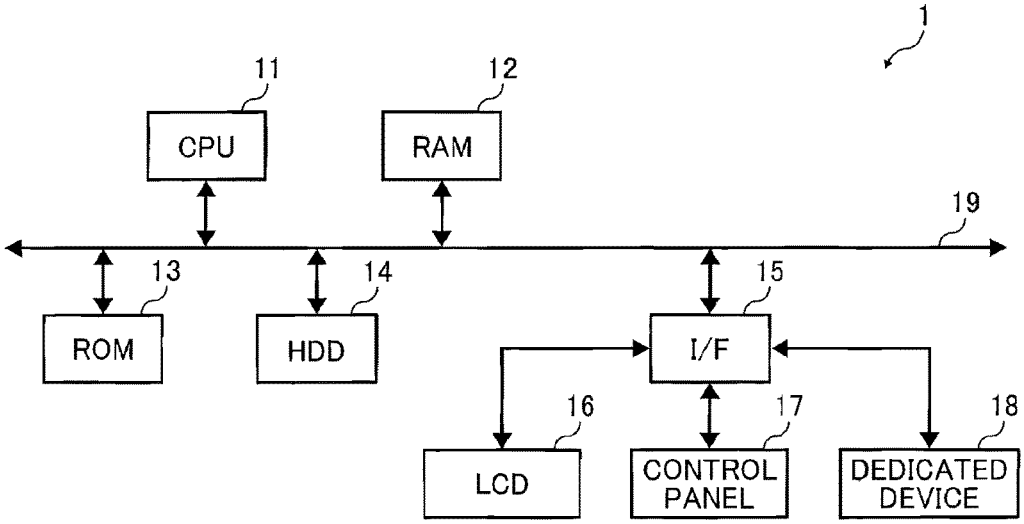
FIG. 1 is a block diagram illustrating hardware of an image forming apparatus according to an exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Hereinafter, a multifunctional peripheral (MFP) is described as one example of an image forming apparatus of an exemplary embodiment.

FIG. 1 is a block diagram illustrating hardware of an image forming apparatus 1 according to the exemplary embodiment. As illustrated in FIG. 1, a configuration of the image forming apparatus 1 is similar to that of a general personal computer (PC) or an information processing apparatus such as a server. That is, the image forming apparatus 1 according to the exemplary embodiment includes a central processing unit (CPU) 11, a random access memory (RAM) 12, a read only memory (ROM) 13, a hard disk drive (HDD) 14, and an interface (I/F) 15 that are connected via a bus 19. Moreover, the image forming apparatus 1 includes a liquid crystal display (LCD) 16, a control panel 17, and a dedicated device 18 that are connected to the I/F 15.

The CPU 11 as an operation unit comprehensively controls operations of the image forming apparatus 1. The RAM 12 is a volatile storage medium, and information can be read from and written in the RAM 12 at high speed. The RAM 12 is used as a working area when the CPU 11 processes information. The ROM 13 is a non-volatile read only storage medium in which programs such as firmware are stored. The HDD 14 is a non-volatile storage medium, and information can be read from and written in the HDD 14. For example, the HDD 14 stores an operating system (OS), various control programs, and application programs.

The I/F 15 connects the bus 19 to various hardware or a network, and controls such connection. The LCD 16 as a visual user interface is used when a user checks a state of the image forming apparatus 1. The control panel 17 as a user interface is used when the user inputs information to the image forming apparatus 1. In the exemplary embodiment, the control panel 17 includes a touch panel or hard keys.

The dedicated device 18 of hardware operates so that the image forming apparatus 1 provides a specific function. The dedicated device 18 is, for example, a print engine for forming an image on a sheet, and a scanner unit for reading an image on a sheet. The image forming apparatus 1 of the exemplary embodiment is characterized by the print engine.

Moreover, a temperature humidity sensor for measuring temperature and humidity inside the image forming apparatus 1 may be disposed as the dedicated device 18. In such a case, the temperature humidity sensor includes a thermistor having a low heat capacity or a temperature sensor such as a silicon-type integrated circuit (IC) sensor, and a humidity sensor such as a polymer-film variable resistance sensor.

With such a hardware configuration, the CPU 11 performs computation according to a program stored in the ROM 13 or a program read from the HDD 14 or a recording medium such as an optical disk to the RAM 12 to provide a software controller. A combination of the software controller and the hardware provides a functional block by which each function of the image forming apparatus 1 is executed.

Next, a functional configuration of the image forming apparatus 1 according to the exemplary embodiment is described.

Figure 2:
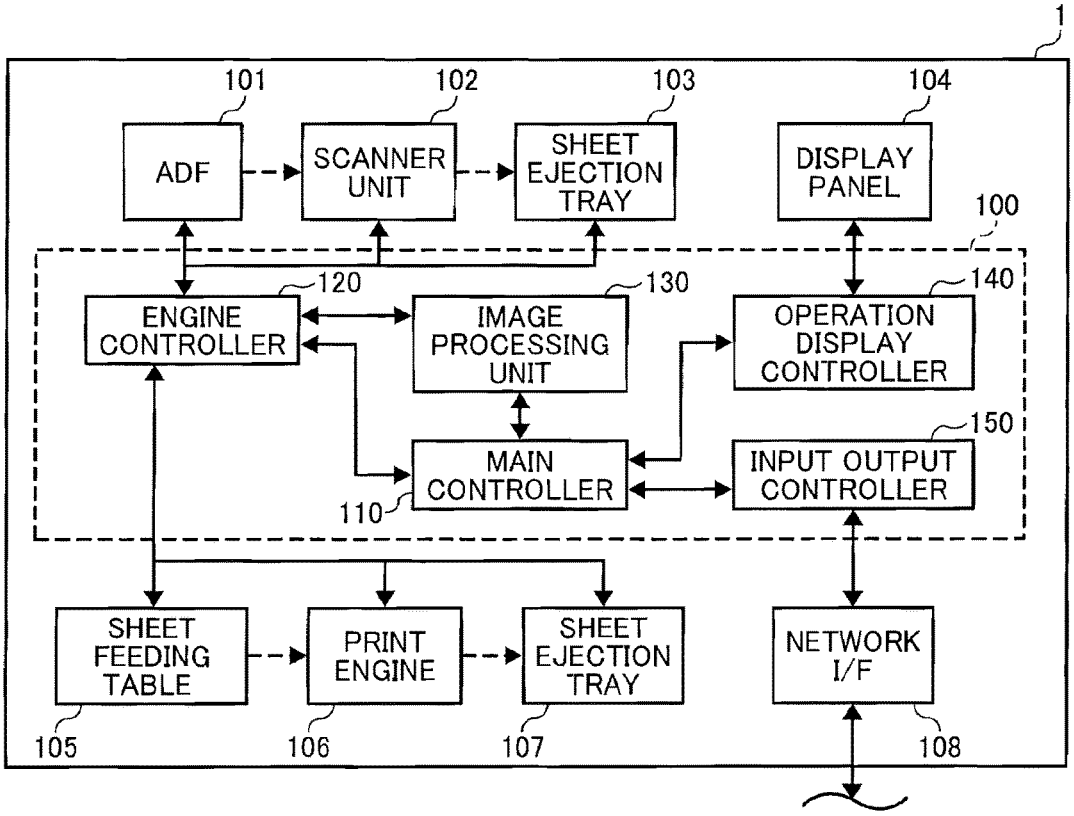
FIG. 2 is a block diagram illustrating a functional configuration of the image forming apparatus according to the exemplary embodiment.

FIG. 2 is a block diagram illustrating the functional configuration of the image forming apparatus 1. As illustrated in FIG. 2, the image forming apparatus 1 includes a controller 100, an automatic document feeder (ADF) 101, a scanner unit 102, a sheet ejection tray 103, a display panel 104, a sheet feeding table 105, a print engine 106, a sheet ejection tray 107, and a network I/F 108.

The controller 100 includes a main controller 110, an engine controller 120, an image processing unit 130, an operation display controller 140, and an input output controller 150. As illustrated in FIG. 2, the image forming apparatus 1 according to the exemplary embodiment is configured as a multifunctional peripheral including the scanner unit 102 and the print engine 106. In FIG. 2, a solid-line arrow indicates an electrical connection, whereas a broken-line arrow indicates a flow of a sheet.

The display panel 104 serves as not only an output interface for visually displaying a state of the image forming apparatus 1, but also an input interface. The display panel 104 of the input interface is used as a touch panel when the user directly operates the image forming apparatus 1 or inputs information with respect to the image forming apparatus 1. That is, the display panel 104 has a function of displaying an image to receive an operation from the user. The display panel 104 functions with the LCD 16 and the control panel 17 illustrated in FIG. 1.

The network I/F 108 enables the image forming apparatus 1 to communicate with other devices via a network. The network I/F 108 includes an Ethernet (registered trademark) interface or a universal serial bus (USB) interface. The network I/F 108 can perform communication using a transmission control protocol/Internet protocol (TCP/IP). Moreover, the network I/F 108 can function as an interface for transmitting a facsimile when the image forming apparatus 1 functions as a facsimile machine. Thus, the network I/F 108 is also connected to a telephone line. The network I/F 108 functions with the I/F 15 illustrated in FIG. 1.

The controller 100 includes a combination of software and hardware. In particular, the controller 100 includes the software controller and hardware such as an integrated circuit. The software controller is provided by performing computation by the CPU 11 according to a program loaded to a volatile memory (hereinafter called a memory) such as the RAM 12 from the ROM 13 or a non-volatile memory and to a program loaded to the memory from the HDD 14 or a non-volatile storage medium such as an optical disk. The controller 100 functions to comprehensively control the image forming apparatus 1.

The main controller 110 has a function of controlling each unit of the controller 100, and issues a command to each of the units of the controller 100. The engine controller 120 functions as a drive unit for controlling or driving the print engine 106 and the scanner unit 102, for example. The image processing unit 130, according to the control by the main controller 110, generates rendering information based on image information to be printed. The term "rendering information" represents information that is used to render an image to be formed by the print engine 106 including image forming units 30Y, 30M, 30C, and 30K in an image forming operation.

Moreover, the image processing unit 130 processes captured-image data that is input from the scanner unit 102 to generate image data. The term "image data" represents information to be stored as a scanner operation result in a storage area of the image forming apparatus 1, or information to be transmitted to another information processing terminal or storage device via the network I/F 108.

The operation display controller 140 displays information on the display panel 104, or notifies the main controller 110 of information that is input via the display panel 104. The input output controller 150 inputs information that is input via the network I/F 108 to the main controller 110. Moreover, the main controller 110 controls the input output controller 150 to access other devices connected to a network via the network I/F 108 and the network.

When the image forming apparatus 1 operates as a printer, the input output controller 150 first receives a print job via the network I/F 108. The input output controller 150 transfers the received print job to the main controller 110. Upon receipt of the print job, the main controller 110 controls the image processing unit 130 to generate rendering information based on document information or image information included in the print job.

In the exemplary embodiment, the print job includes information of a parameter that is set for image formation in addition to image information in which information of an output target image is described in a format analyzable by the image processing unit 130 of the image forming apparatus 1. The parameter information is, for example, information of a two-sided print setting, an aggregate print setting, and a color/monochrome setting.

When the rendering information is generated by the image processing unit 130, the engine controller 120 controls the print engine 106, based on the generated rendering information, to form an image on a sheet conveyed from the sheet feeding table 105. That is, the image processing unit 130, the engine controller 120, and the print engine 106 function as an image forming outputting unit. In particular, an electrophotographic image forming system is used as the print engine 106 in the exemplary embodiment. A document with the image formed by the print engine 106 is ejected to the sheet ejection tray 107.

When the image forming apparatus 1 operates as a scanner, the operation display controller 140 or the input output controller 150 transfers a scan execution signal to the main controller 110 according to an operation of the display panel 104 by the user or an scan execution instruction input by another device via the network I/F 108. The main controller 110 controls the engine controller 120 based the received scan execution signal.

The engine controller 120 drives the ADF 101 to convey an image capturing target document placed on the ADF 101 to the scanner unit 102. Moreover, the engine controller 120 drives the scanner unit 102 to capture an image of the document conveyed from the ADF 101. If the document is directly placed on the scanner unit 102 instead of the ADF 101, the scanner unit 102 captures an image of the document according to the control by the engine controller 120. That is, the scanner unit 102 operates as an image capturing unit, and the engine controller 120 function as a reading controller.

In the image capturing operation, an image capturing device such as a contact image sensor (CIS) or a charge-coupled device (CCD) disposed in the scanner unit 102 optically scans the document to generate captured-image information based on the optical information. The engine controller 120 transfers the captured-image information generated by the scanner unit 102 to the image processing unit 130. Subsequently, the image processing unit 130 generates image information based on the captured-image information received from the engine controller 120 according to the control by the main controller 110.

The main controller 110 acquires the image information generated by the image processing unit 130, and stores the image information in a storage medium such as the HDD 14 attached to the image forming apparatus 1. That is, the scanner unit 102, the engine controller 120, and the image processing unit 130 operate in response to one another to function as an image input unit. The image information generated by the image processing unit 130 is stored as is in the storage medium such as the HDD 14 according to an instruction from the user, or transmitted to an external device via the input output controller 150 and the network I/F 108.

Moreover, when the image forming apparatus 1 operates as a copier, the image processing unit 130 generates rendering information based on captured-image information received by the engine controller 120 from the scanner unit 102 or image information generated by the image processing unit 130. Similar to the operation performed when the image forming apparatus 1 operates as the printer, the engine controller 120 drives the print engine 106 based on the rendering information.

Figure 3:
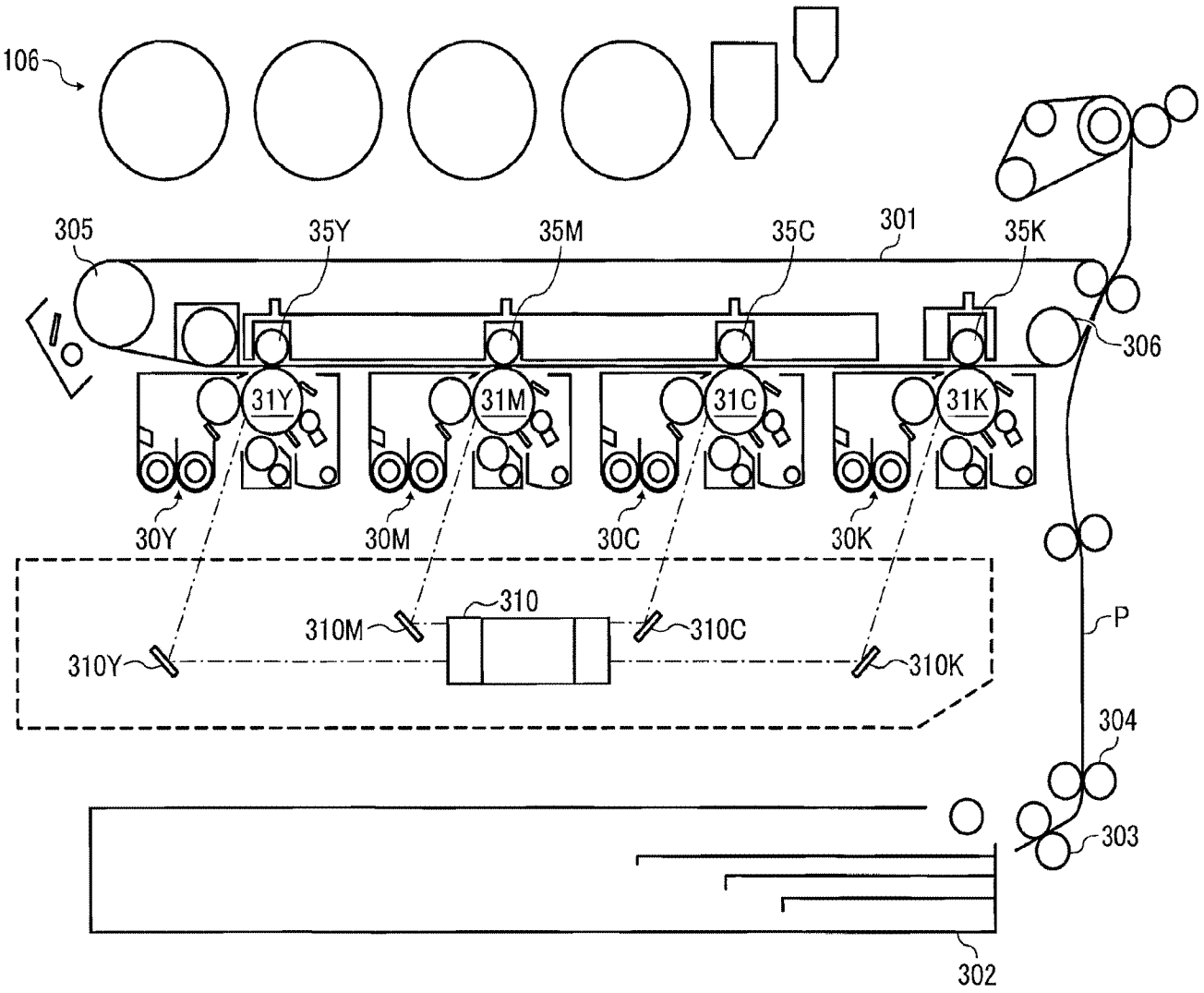
FIG. 3 is a schematic diagram illustrating the image forming apparatus according to the exemplary embodiment.

Next, the print engine 106 of the image forming apparatus 1 according to the exemplary embodiment is described with reference to FIG. 3. The print engine 106 of a tandem type includes the image forming units 30Y, 30M, 30C, and 30K arranged along a conveyance belt 301 of an endless moving member. Moreover, the print engine 106 includes transfer rollers 35Y, 35M, 35C, and 35K. A sheet P (one example of the recording media) from a sheet feeding tray 302 is fed by a sheet feeding roller 303, and then conveyed along the conveyance belt 301 as an intermediate transfer belt on which an intermediate transfer image to be transferred to the sheet P is formed. The plurality of image forming units (electrophotographic processing units) 30Y, 30M, 30C, and 30K are arranged in order from an upstream side in the direction of movement of the conveyance belt 301. In the following description, the image forming units 30Y, 30M, 30C, and 30K may be collectively called the image forming units 30 as necessary.

Moreover, conveyance of the sheet P fed from the sheet feeding tray 302 is temporality stopped by a registration roller 304. The registration roller 304 times the conveyance of the sheet P with image formation in the image forming units 30Y, 30M, 30C, and 30K to feed the sheet P to an image transfer position from which the image is transferred from the conveyance belt 301.

Each of the image forming units 30Y, 30M, 30C, and 30K is substantially similar to every other except for the color of a toner image to be formed. The image forming units 30Y, 30M, 30C, and 30K respectively form images of yellow, magenta, cyan, and black. Accordingly, a description is hereinafter given of configurations of only the image forming unit 30Y as a representative of the image forming units 30Y, 30M, 30C, and 30K. Since each component illustrated with a reference numeral with color abbreviation Y of the image forming unit 30Y is similar to each component of the image forming units 30M, 30C, and 30K except for the color of toner, descriptions of the image forming units 30M, 30C, and 30K are omitted.

The conveyance belt 301 as an endless belt looped around a drive roller 305 and a driven roller 306. The drive roller 305 is rotated by a drive motor. The drive motor, the drive roller 305, and the driven roller 306 function as a drive unit for moving the conveyance belt 301 of the endless moving member. In FIG. 3, although an optical writing device 310 is configured to irradiate each of the photoconductor drums 31Y, 31M, 31C, and 31K with light, optical writing devices 310Y, 310M, 310C, and 310K are also illustrated for the sake of the following description.

Figure 4:
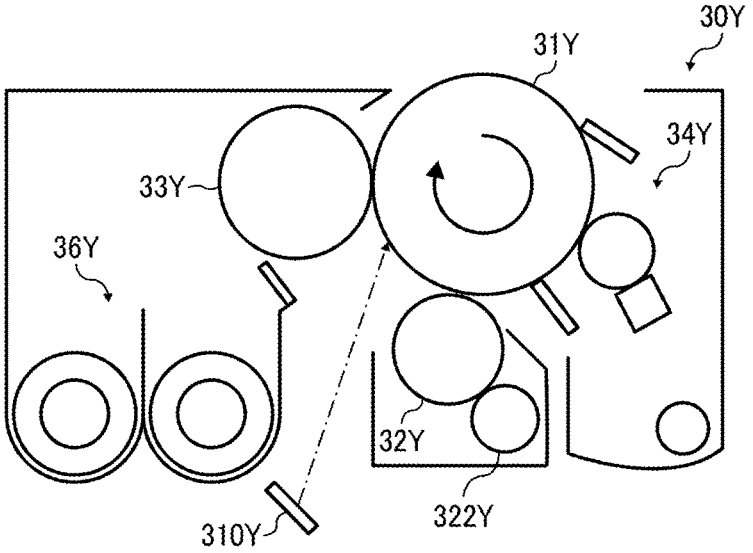
FIG. 4 is a diagram illustrating an image forming unit disposed in the image forming apparatus according to the exemplary embodiment.

When an image is formed, the first image forming unit 30Y transfers a yellow toner image to the conveyance belt 301 being rotated. Hereinafter, the image forming unit 30Y of the image forming apparatus 1 according to the exemplary embodiment is described with reference to a sectional view illustrated FIG. 4. The image forming unit 30Y includes a photoconductor drum 31Y as a photoconductor, a charging roller 32Y as a charger disposed opposite the photoconductor drum 31Y, the optical writing device 310Y, a developing device 33Y, a photoconductor cleaner 34Y, and a toner supply unit 36Y. In FIG. 4, the optical writing device 310Y irradiates the photoconductor drum 31Y.

The photoconductor drum 31Y includes an organic photoconductive layer and a surface layer that are sequentially laminated around a drum-shaped conductive supporting member. The organic photoconductive layer includes a charge generation layer and a charge transport layer. The charge transport layer has a thickness that can be selected from a range of 10 μm to 40 μm according to a characteristic of the photoconductor drum 31Y. Moreover, a subbing layer can be formed between the conductive supporting member and the organic conductive layer as necessary.

The charging roller 32Y includes a cored bar to which a charging bias is applied by a direct current (DC) power supply or an alternating current (AC) power supply. Electrical discharge occurs in an air gap between the charging roller 32Y and the photoconductor drum 31Y, so that the photoconductor drum 31Y is uniformly charged via a charge gap. A cleaning brush roller 322Y is disposed to contact the charging roller 32Y to remove toner adhering to the charging roller 32Y.

The optical writing device 310Y irradiates the uniformly charged photoconductor drum 31Y with light based on the rendering information to form an electrostatic latent image on the photoconductor drum 31Y. The optical writing device 310Y employs an optical writing method such as a polygon scanning method and a light emitting diode (LED) array method.

The developing device 33Y develops the electrostatic latent image formed by the optical writing device 310Y by rendering toner adhere to the photoconductor drum 31Y. This forms a yellow toner image on the photoconductor drum 31Y. Herein, the toner supply unit 36Y supplies the toner to the developing device 33Y.

In a position (a transfer position) in which the photoconductor drum 31Y and the conveyance belt 301 contact each other or are closest to each other, the toner image is transferred to the conveyance belt 301 by a transfer roller 35Y as a transfer device. Hence, the yellow toner image is formed on the conveyance belt 301. After the toner image is transferred from the photoconductor drum 31Y, a photoconductor cleaner 34Y removes an unnecessary toner remaining on a circumferential surface of the photoconductor drum 31Y. Subsequently, the optical writing device 310Y irradiates the photoconductor drum 31Y with light again, thereby removing charge from the photoconductor drum 31Y. When the charge is removed by the light, the photoconductor drum 31Y is on standby for next image formation.

Figure 5:
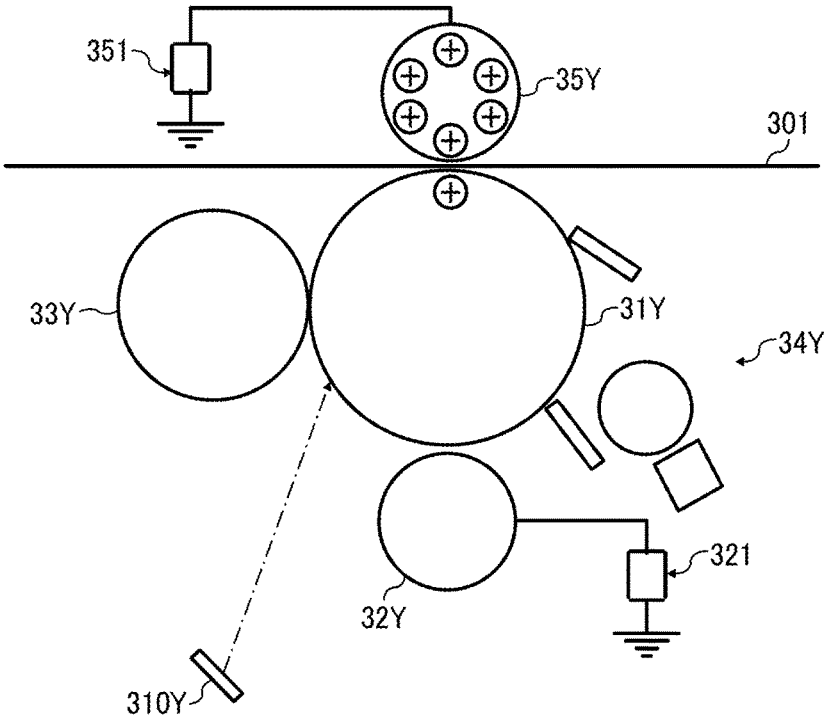
FIG. 5 is a diagram illustrating electric charge flowing to a photoconductor drum disposed in the image forming apparatus according to the exemplary embodiment.

The image forming unit 30Y performs such operations, so that a series of electrophotographic processes in the image forming apparatus 1 according to the exemplary embodiment is completed. In the series of the electrophotographic processes, an emergency stop may be made partway through the processes due to an inadequate amount of toner or a conveyance failure of a sheet P. In such a case, the image forming apparatus 1 cannot form or output an image. As illustrated in FIG. 5, if the image forming unit 30Y makes an emergency stop, electric charge flows into the photoconductor drum 31Y from the transfer roller 35Y for transferring the toner image. Consequently, the photoconductor drum 31Y is charged with excessive electric charge.

Figure 6:
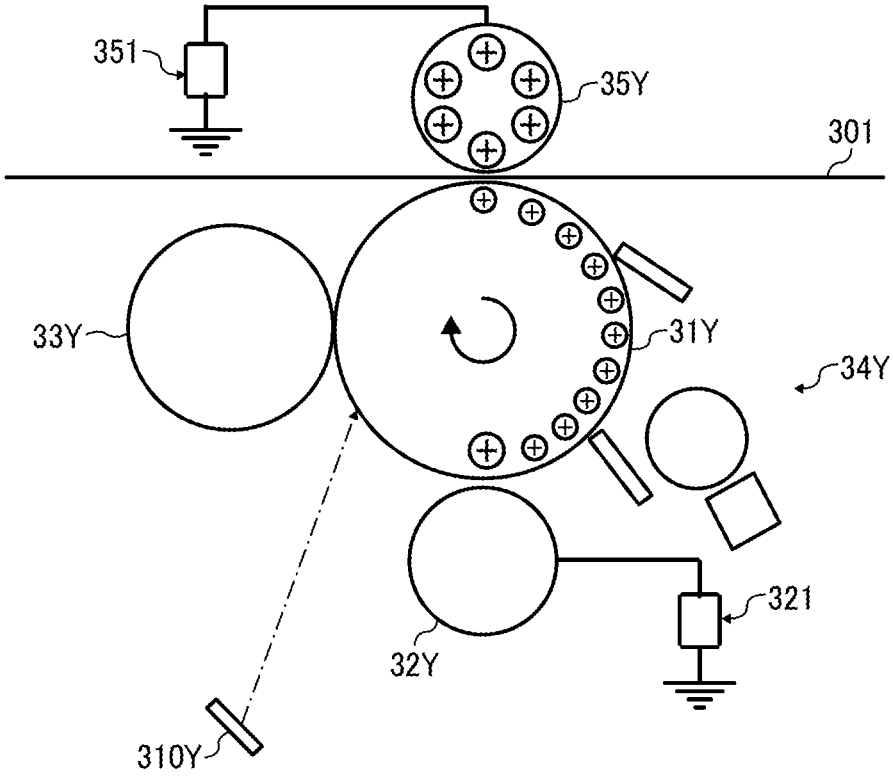
FIG. 6 is a diagram illustrating the electric charge flowing to the photoconductor drum.

In a case in which the operation is resumed in such a state, the photoconductor drum 31Y is rotated while a surface thereof is being charged with the electric charge as illustrated in FIG. 6, a diagram illustrating the electric charge flowing to the photoconductor drum. If the rotation of the photoconductor drum 31Y continues as is, the excessive electric charge on the photoconductor drum 31Y flows into the charging roller 32Y.

Herein, the charging roller 32Y receives superimposition of DC power supply and AC power supply. Generally, the AC power supply takes longer from the beginning of operation to activation than the DC power supply. The flow of the electric charge into the charging roller 32Y during such a time may cause a failure in a power supply device that supplies DC power to the charging roller 32Y. In a case in which the photoconductor drum 31Y is charged with the excessive electric charge, the image forming apparatus 1 according to the exemplary embodiment can reduce the electric charge flowing from the photoconductor drum 31Y into the charging roller 32Y.

Figure 7:
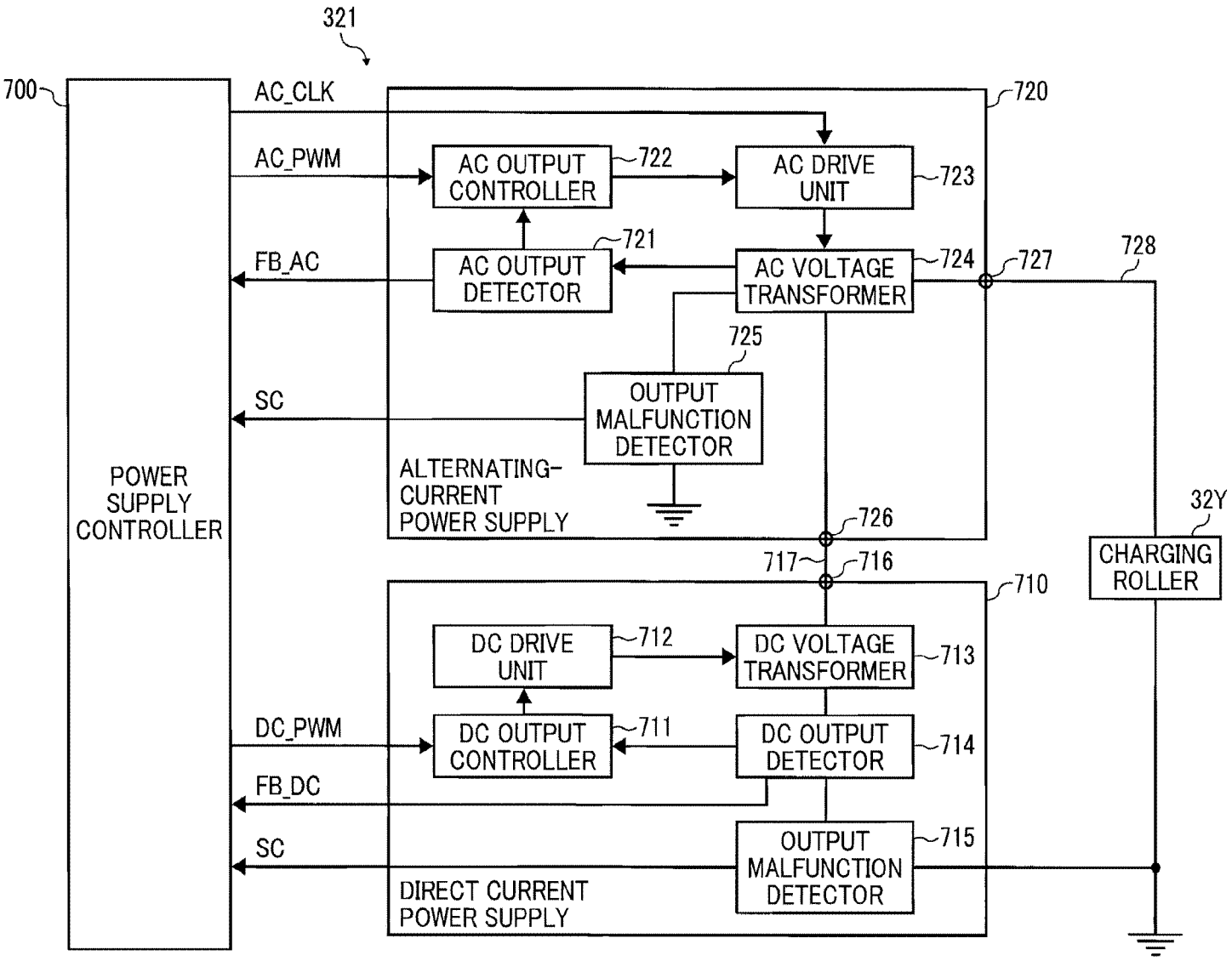
FIG. 7 is a diagram illustrating a charge power supply device disposed in the image forming apparatus according to the exemplary embodiment.
Figure 8:
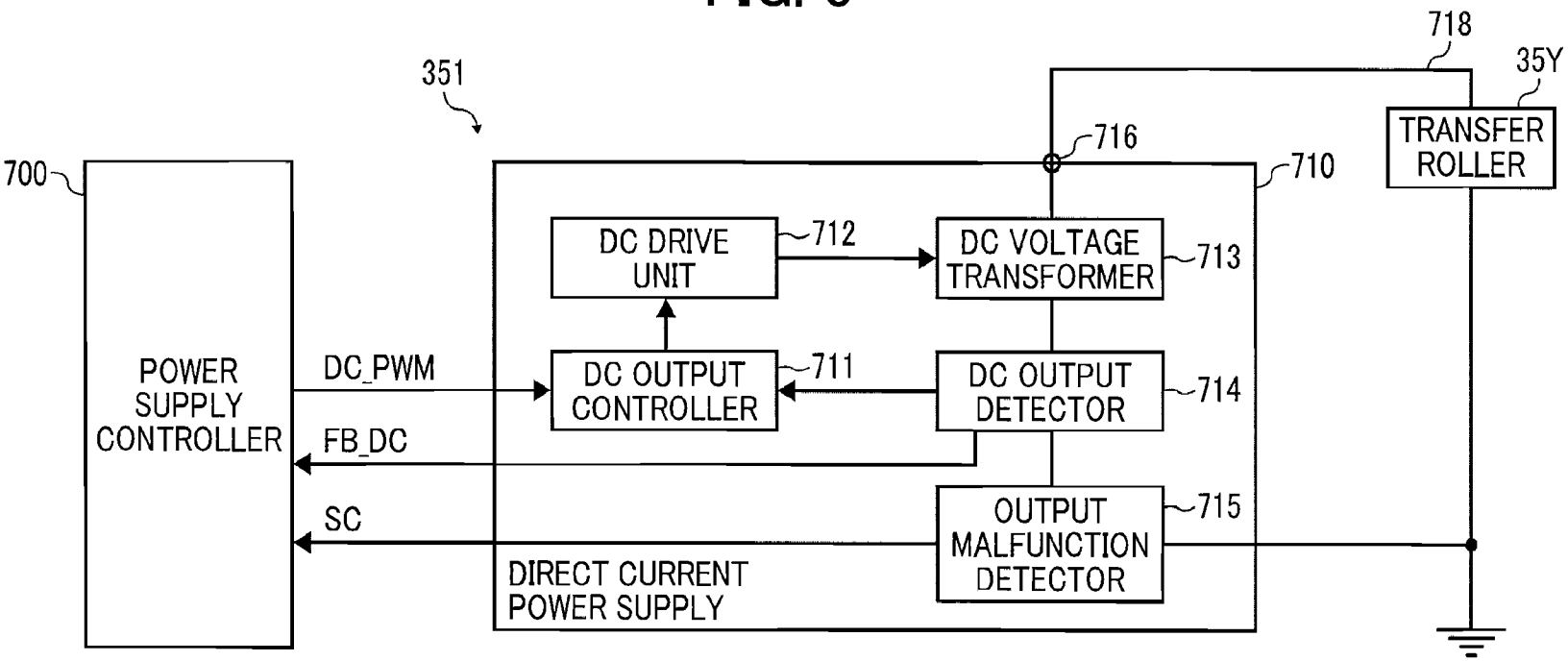
FIG. 8 is a diagram illustrating a transfer power supply device disposed in the image forming apparatus according to the exemplary embodiment.

In the exemplary embodiment, the transfer roller 35Y receives power supply from a DC power supply device, whereas the charging roller 32Y receives power supply from a power supply device in which DC power supply and AC power supply are superimposed. FIG. 7 is a diagram illustrating a power supply device (a charge power supply device 321) connected to the charging roller 32Y, and FIG. 8 is a diagram illustrating a power supply device (a transfer power supply device 351) connected to the transfer roller 35Y. Hereinafter, the charge power supply device 321 and the transfer power supply device 351 are respectively described with reference to FIGS. 7 and 8. Similar to the above description, the image forming unit 30Y is used as a representative of the image forming units 30Y, 30M, 30C, and 30K in the following description.

As illustrated in FIG. 7, the charge power supply device 321 includes a DC power supply 710 and an AC power supply 720. The charge power supply device 321 supplies power by superimposing power supply from the AC power supply 720 on power supply from the DC power supply 710. Thus, the charging roller 32Y as the charger and the charge power supply device 321 cooperate with each other. Accordingly, in an electric circuit of the charge power supply device 321 for supplying power by superimposing the power supply from the AC power supply 720 on the power supply from the DC power supply 710, electric connectors 716 and 726 are electrically connected via a harness 717. Moreover, a DC voltage transformer 713 outputs a DC voltage to the AC power supply 720 via the harness 717. A description is given of configurations of the DC power supply 710 and the AC power supply 720 of the charge power supply device 321.

The DC power supply 710 includes a DC output controller 711, a DC drive unit 712, the DC voltage transformer 713, a DC output detector 714, an output malfunction detector 715, and the electric connector 716. A power supply controller 700 includes hardware such as the CPU 11 and the RAM 12 having a computation function, and controls the DC power supply 710.

The DC output controller 711 receives a DC_PWM signal from the power supply controller 700. The DC_PWM signal is used to control a DC voltage output. Moreover, the DC output controller 711 receives an output value of the DC voltage transformer 713 from the DC output detector 714, the output value being detected by the DC output detector 714. The DC output controller 711 controls the DC voltage transformer 713 based on a duty ratio of the received DC_PWM signal and the received output value of the DC voltage transformer 713. In particular, the DC output controller 711 controls the driving of the DC voltage transformer 713 via the DC drive unit 712 such that an output value of the DC voltage transformer 713 is an output value designated by the DC_PWM signal.

The DC drive unit 712 drives the DC voltage transformer 713 according to the control by the DC output controller 711. The DC voltage transformer 713 is driven by the DC drive unit 712 to output a high DC voltage having a negative polarity. Similar to the charging roller 32Y, in a device that is driven by receiving power supply by superimposing an AC voltage on a DC voltage from the DC power supply 710, the electric connectors 716 and 726 are electrically connected via the harness 717. Therefore, the DC voltage transformer 713 outputs a DC voltage to an AC voltage transformer 724 via the harness 717.

The DC output detector 714 detects an output value of the high DC voltage of the DC voltage transformer 713, and outputs the detected output value to the DC output controller 711. Moreover, the DC output detector 714 outputs the detected output value to the power supply controller 700 as an FB_DC signal (a feedback signal). The FB_DC signal is output, so that the power supply controller 700 controls duty of the DC_PWM signal to prevent degradation in transferability due to environment or load.

The output malfunction detector 715 is disposed on an output line of the DC power supply 710 to output a service channel (SC) signal indicating an output malfunction such as a leakage to the power supply controller 700. Upon receipt of the SC signal, the power supply controller 700 executes a control operation to stop the high-voltage output from the DC power supply 710. Such a control operation can stop the high-voltage output from the DC power supply 710 to the charging roller 32Y when a power supply leakage occurs.

Next, the AC power supply 720 is described. The AC power supply 720 includes an AC output controller 722 to which an AC_PWM signal is input from the power supply controller 700. The AC_PWM signal is used to control an AC voltage output. Moreover, the AC output controller 722 receives an output value of the AC voltage transformer 724 from an AC output detector 721, the output value being detected by the AC output detector 721. The AC output controller 722 controls the AC voltage transformer 724 based on a duty ratio of the received AC_PWM signal and the received output value of the AC voltage transformer 724. In particular, the AC output controller 722 controls the driving of the AC voltage transformer 724 via an AC drive unit 723 such that an output value of the AC voltage transformer 724 is an output value designated by the AC_PWM signal.

The AC drive unit 723 receives an AC_CLK signal for controlling a frequency of the AC voltage output. The AC drive unit 723 drives the AC voltage transformer 724 based on the control by the AC output controller 722 and the AC_CLK signal. The AC drive unit 723 controls the driving of the AC voltage transformer 724 via the AC drive unit 723 based on the AC_CLK signal such that an output value of the AC voltage transformer 724 is a value designated by the AC_CLK signal.

The AC voltage transformer 724 is driven by the AC drive unit 723 to generate an AC voltage, and superimposes the generated AC voltage on a high DC voltage output from the DC voltage transformer 713 to generate a superimposed voltage. Then, the AC voltage transformer 724 outputs the superimposed voltage to the charging roller 32Y via an electric connector 727 and a harness 728. If an AC voltage is not generated, the AC voltage transformer 724 outputs the high DC voltage output from the DC voltage transformer 713 to the charging roller 32Y via the electric connector 727 and the harness 728.

The AC output detector 721 detects an output value of the AC voltage of the AC voltage transformer 724, and outputs the detected output value to the AC output controller 722. Moreover, the AC output detector 721 outputs the detected output value to the power supply controller 700 as an FB_AC signal (a feedback signal). The FB_AC signal is output, so that the power supply controller 700 controls duty of the AC_PWM signal to prevent degradation in transferability due to environment or load.

Moreover, the AC power supply 720 includes an output malfunction detector 725. The output malfunction detector 725 is disposed on an output line of the AC power supply 720 to output a service channel (SC) signal indicating an output malfunction such as a leakage to the power supply controller 700.

In the exemplary embodiment, the AC power supply 720 performs the constant voltage control operation. However, the AC power supply 720 may perform a constant current control operation. Moreover, the AC voltage generated by the AC voltage transformer 724 (the AC power supply 720) may be any of a sine wave and a rectangular wave.

As illustrated in FIG. 8, the transfer power supply device 351 supplies power using a DC power supply. A functional configuration of the transfer power supply device 351 is common to that of the DC power supply 710 illustrated in FIG. 7. Hereinafter, the transfer power supply device 351 is described by referring to the differences between the transfer power supply device 351 illustrated in FIG. 8 and the DC power supply 710 illustrated in FIG. 7.

As illustrated in FIG. 8, in an electric circuit of the transfer power supply device 351 for supplying power using the DC voltage output from the DC power supply 710, the transfer roller 35Y and the electric connector 716 are electrically connected via a harness 718. Accordingly, the DC voltage transformer 713 outputs the DC voltage to the transfer roller 35Y via the harness 718. Unlike the charge power supply device 321 illustrated in FIG. 7 in which the power supply from the AC power supply 720 is superimposed, the DC power supply 710 of the transfer power supply device 351 illustrated in FIG. 8 supplies power to the transfer roller 35Y without superimposition. Hence, the DC voltage output from the DC power supply 710 is applied to the transfer roller 35Y via the harness 718.

Therefore, the transfer power supply device 351 and the charge power supply device 321 respectively control the power supply to the transfer roller 35Y and the charging roller 32Y according to the exemplary embodiment.

Figure 9:
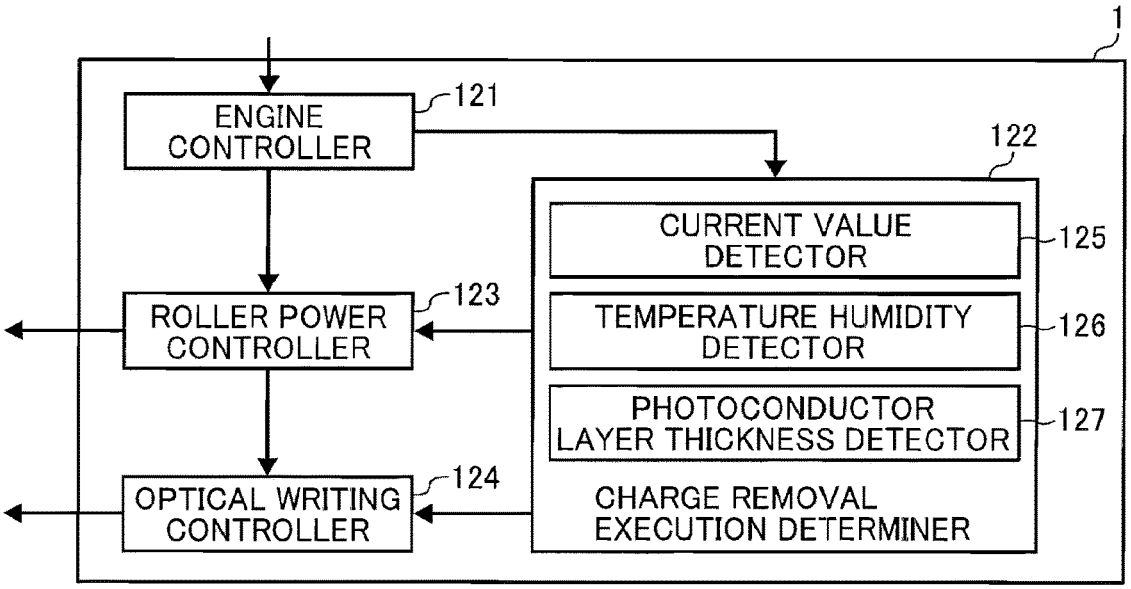
FIG. 9 is a diagram illustrating a control configuration of the image forming apparatus according to the exemplary embodiment.

Next, a control configuration of the image forming apparatus 1 is described with reference to FIG. 9.

The image forming apparatus 1 includes an engine controller 121, a charge removal execution determiner 122, a roller power controller 123, and an optical writing controller 124. The engine controller 121 receives a command from a higher-level controller, and inputs a command to form an electrostatic latent image corresponding to an output target image. The image forming unit 30Y executes an electrophotographic process according to the command output from the engine controller 121. Moreover, the engine controller 121 determines whether a charge removal operation is necessary in the control by the image forming apparatus 1 to control the charge removal operation.

The charge removal execution determiner 122 includes a current value detector 125, a temperature humidity detector 126, and a photoconductor layer thickness detector 127. The charge removal execution determiner 122 controls the charging roller 32Y or the optical writing device 310Y based on the command input by the engine controller 121, so that charge is removed from the photoconductor drum 31Y. If the image forming apparatus 1 transfers a toner image without an emergency stop in the course of electrophotographic process, the charge removal execution determiner 122 outputs a command to the optical writing controller 124 to remove the charge from the photoconductor drum 31Y using the optical writing device 310Y. If there is an emergency stop in the course of the electrophotographic process, the charge removal execution determiner 122 outputs a command (an charge removal command) to the roller power controller 123 to remove the charge from the photoconductor drum 31Y by applying an AC voltage to the charging roller 32Y.

The roller power controller 123 receives the charge removal command from the charge removal execution determiner 122 to remove the charge from the photoconductor drum 31Y, and renders the AC power supply 720 to supply power to the charging roller 32Y to remove the charge from the photoconductor drum 31Y (to execute AC charge removal discharge).

The optical writing controller 124 receives the charge removal command from the charge removal execution determiner 122, and renders the optical writing device 310Y to remove the charge from the photoconductor drum 31Y. In the image forming apparatus 1 according to the exemplary embodiment, the optical writing device 310Y irradiates the photoconductor drum 31Y with light in normal image formation. The charge of the photoconductor drum 31Y is removed by irradiation of the photoconductor drum 31Y with light by the optical writing device 310Y.

In the normal electrophotographic process, the optical writing device 310Y optically removes the charge from the photoconductor drum 31Y after the toner image corresponding to the electrostatic latent image is transferred. However, in a case in which the electrophotographic process stops partway, a positive electric charge flows into the photoconductor drum 31Y by the DC voltage applied to the transfer roller 35Y. This causes the photoconductor drum 31Y to be charged with excessive positive electric charge.

In a case in which the image forming apparatus 1 performs a recovery operation in a state in which the photoconductor drum 31Y remains charged with the excessive positive electric charge, the positive electric charge flows into the charging roller 32Y due to a potential difference between the photoconductor drum 31Y and the charging roller 32Y. In a case in which the flow of the positive electric charge into the charging roller 32Y occurs in a state in which the DC power supply is applied to the charge power supply device 321, the charge power supply device 321 malfunctions and the image forming apparatus 1 stops working.

Such an event needs to be prevented. Accordingly, if there is an emergency stop partway through the electrophotographic process, the image forming apparatus 1 according to the exemplary embodiment performs AC charge removal discharge at activation of the charge power supply device 321 to remove the charge from the photoconductor drum 31Y by rotating the photoconductor drum 31Y. Alternatively, the image forming apparatus 1 can perform AC charge removal discharge using the charging roller 32Y after rotation of the photoconductor drum 31Y is resumed. The image forming apparatus 1 may start the AC charge removal discharge, and then execute DC charging at a time when the photoconductor drum 31Y has made one rotation. In such a case, an image forming operation can be executed again without necessity of a long time period even if the image forming apparatus 1 makes an emergency stop.

Figure 10:
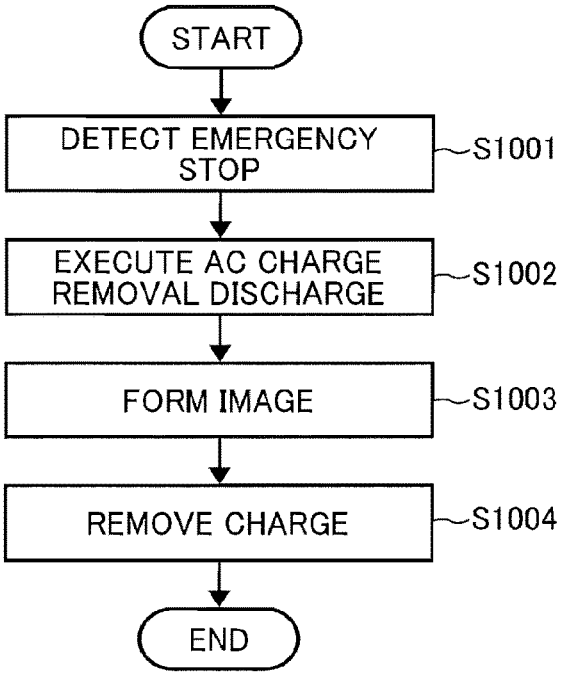
FIG. 10 is a flowchart illustrating a recovery operation performed by the image forming apparatus according to the exemplary embodiment.

FIG. 10 is a flowchart illustrating a procedure performed by the image forming apparatus 1 according to the exemplary embodiment. In step S1001, the charge removal execution determiner 122, based on a command from the engine controller 121, detects that the image forming apparatus 1 has made an emergency stop partway through the electrophotographic process. Upon such detection, the charge removal execution determiner 122 outputs a command to the roller power controller 123 to execute AC charge removal discharge by applying an AC voltage to the charging roller 32Y.

Upon receipt of the command to execute the AC charge removal discharge from the charge removal execution determiner 122, the roller power controller 123 transmits such a command to the power supply controller 700 of the charge power supply device 321 which supplies power to the charging roller 32Y. In step S1002, the power supply controller 700 receives the command from the roller power controller 123, and controls the charge power supply device 321 to execute the AC charge removal discharge according to the command.

When the AC charge removal discharge in the charging roller 32Y is completed, the process proceeds to step S1003 in which the image forming unit 30Y forms an image by image forming outputting operation. Subsequently, in step S1004, the optical writing controller 124 controls the optical writing device 310Y, so that the photoconductor drum 31Y is irradiated with light to delete electrostatic latent image history (to remove charge).

The procedure illustrated in FIG. 10 has been described using an example case in which the image forming apparatus 1 performs the recovery operation for recovering from the emergency stop, and a series of electrophotographic processes ends without a malfunction. In a case in which any malfunction occurs in a series of the processes illustrated in FIG. 10, the process may return to step S1001 to execute the series of the processes illustrated in FIG. 10 again.

In the exemplary embodiment, therefore, the image forming apparatus 1 removes charge from the photoconductor drum 31Y by AC charging at activation of the charge power supply device 321 such that a potential difference between the photoconductor drum 31Y and the charging roller 32Y is reduced. Accordingly, such reduction in the potential difference between the photoconductor drum 31Y and the charging roller 32Y reduces the positive electric charge flowing from the photoconductor drum 31Y into the charging roller 32Y, thereby reducing a malfunction of the charging device.

Another Exemplary Embodiment

The image forming apparatus 1 according to the above exemplary embodiment executes emergency stop control if the main controller 110 detects a malfunction such as toner exhaustion and a sheet jam in any of the image forming units 30Y, 30M, 30C, and 30K. Hereinafter, an image forming apparatus according to another exemplary embodiment is described. Components and configurations that are similar to the above exemplary embodiment are given the same reference numerals as above and description thereof will be omitted. Similar to the above exemplary embodiment, each of image forming units 30Y, 30M, 30C, and 30K is substantially similar to every other except for the color of a toner image to be formed, the image forming unit 30Y is described as a representative the image forming units 30Y, 30M, 30C, and 30K. An image forming apparatus 1 can allow a current value detector 125, a temperature humidity detector 126, and a photoconductor layer thickness detector 127 in the charge removal execution determiner 122 to determine whether to render a charging roller 32Y to execute AC charge removal discharge.

The current value detector 125 determines that AC charge removal discharge is to be executed if an electric current exceeding an electric current value determined from a discharge start voltage and a resistance value of the transfer roller 35Y flows to the transfer roller 35Y. Herein, the discharge start voltage can be determined by a function of atmospheric pressure and an air gap width (a nip width) between the photoconductor drum 31Y and the transfer roller 35Y. Since the electrophotographic image forming apparatus 1 is used under the atmospheric pressure, the discharge start voltage is determined by a function that depends on only the air gap width between the photoconductor drum 31Y and the transfer roller 35Y.

Figure 11:
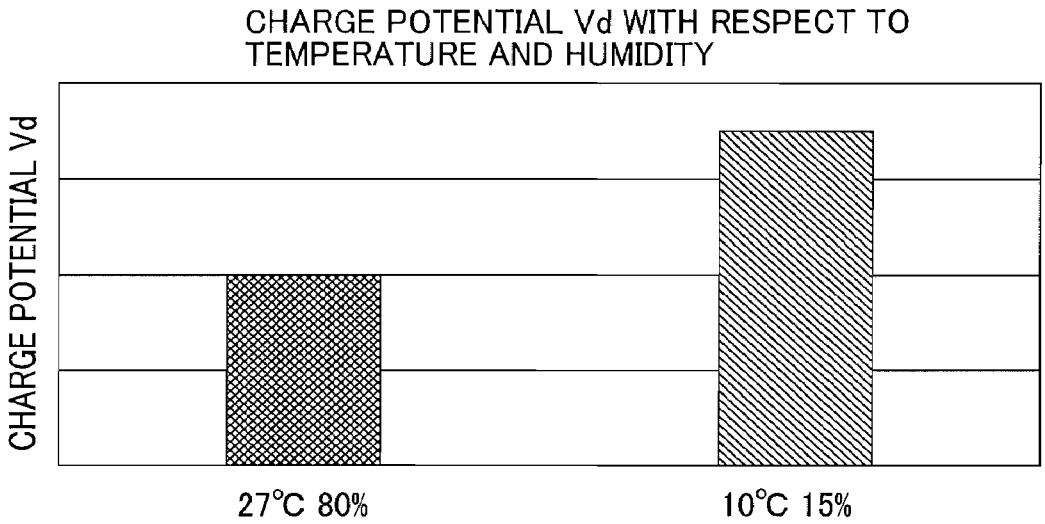
FIG. 11 is a diagram illustrating a relation between a charge potential and environment of an image forming apparatus according to another exemplary embodiment.

The image forming apparatus 1 includes a temperature humidity sensor including a thermistor having a low heat capacity or a temperature sensor such as a silicon-type IC sensor, and a humidity sensor such as a polymer-film variable resistance sensor. FIG. 11 is a graph illustrating a charge potential Vd of a photoconductor interface with respect to temperature and humidity. As illustrated in FIG. 11, the higher the absolute humidity and the relative humidity, the lower the charge potential Vd of the photoconductor interface. An increase in the absolute humidity and the relative humidity facilitates diffusion of static electricity. This increases electric inductivity on the photoconductor interface, and electric charge leakage speed is increased. Hence, the graph illustrated in FIG. 11 is obtained.

The temperature humidity detector 126 determines whether execution of AC charge removal discharge is needed based on measurements of temperature and humidity inside the image forming apparatus 1, the measurements being obtained by a temperature humidity sensor. Herein, the temperature humidity detector 126 defines a threshold value based on fluctuations in electric inductivity that is unique to a material used as a base material of the photoconductor. If the temperature and humidity exceeds the threshold value, the temperature humidity detector 126 determines to execute the AC charge removal discharge.

Figure 12:
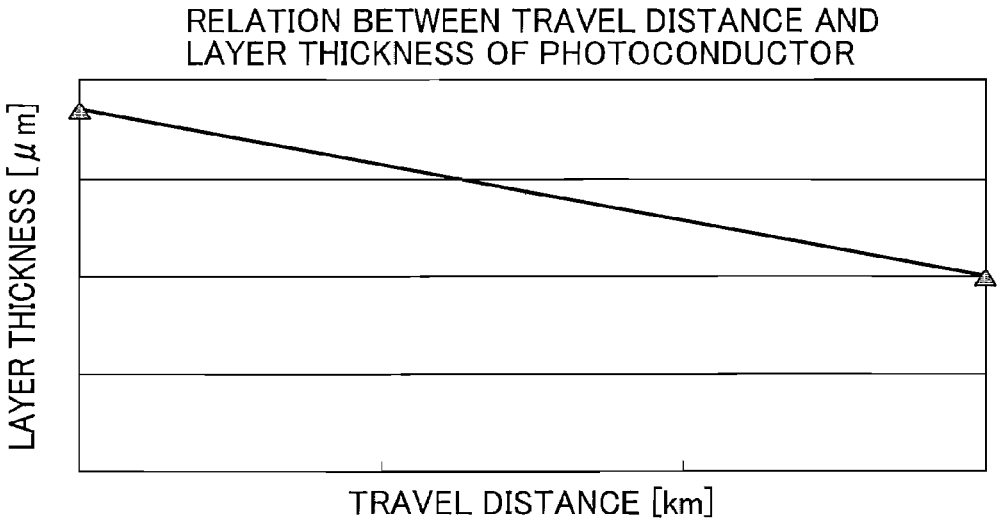
FIG. 12 is a diagram illustrating a relation between a travel distance and a layer thickness of a photoconductor drum of an image forming apparatus according to another exemplary embodiment.

The photoconductor drum 31Y deteriorates over time due to abrasion of a surface layer thereof. When the cumulative number of rotations of the photoconductor drum 31Y increases, the surface layer of the photoconductor drum 31Y is abraded, and thus a circumference of the photoconductor drum 31Y is reduced. FIG. 12 is a diagram illustrating a relation between a travel distance and a layer thickness of the photoconductor drum 31Y based on the cumulative number of rotations of the photoconductor drum 31Y. As illustrated in FIG. 12, the layer thickness of the photoconductor drum 31Y decreases as the travel distance of the photoconductor drum 31Y increases.

The photoconductor layer thickness detector 127 counts the cumulative number of rotations of the photoconductor drum 31Y, and calculates a travel distance of the photoconductor drum 31Y based on the counted number to determine whether to render the charging roller 32Y to execute AC charge removal discharge based on the calculated result. Herein, the information indicating the relation between the travel distance and the layer thickness of the photoconductor drum 31Y illustrated in FIG. 12 is stored beforehand in a storage area such as an HDD 14 disposed in the image forming apparatus 1. As illustrated in FIG. 12, the greater the travel distance of the photoconductor drum 31Y, the smaller the layer thickness of the photoconductor drum 31Y. Consequently, the smaller the layer thickness, the less likely the photoconductor drum 31Y is to be charged with a positive electric charge.

The photoconductor layer thickness detector 127 calculates a layer thickness of the photoconductor drum 31Y from a travel distance of the photoconductor drum 31Y. Herein, if the layer is abraded to a thickness where a malfunction no longer occurs in the charge power supply device 321 by movement of electric charge between the photoconductor drum 31Y and the charging roller 32Y, the photoconductor layer thickness detector 127 determines that the travel distance of the photoconductor drum 31Y exceeds a predetermined travel distance. Moreover, if the travel distance of the photoconductor drum 31Y exceeds the predetermined travel distance, the photoconductor layer thickness detector 127 determines to advance an application time of a DC voltage to perform AC charge removal discharge. The DC voltage is applied after the AC voltage is applied to an area corresponding to one circumference of the photoconductor drum 31Y, the one circumference being calculated based on the layer thickness acquired when the travel distance exceeds the predetermined travel distance. Thus, when the photoconductor layer thickness detector 127 determines to execute the AC charge removal discharge, an application time of the DC voltage to the charging roller 32Y is advanced. Accordingly, when an application time of the DC voltage is advanced, the image forming apparatus 1 can perform a recovery operation promptly.

Moreover, a photoconductor cleaner 34Y may include a lubricant. In such a case, when AC charge removal discharge is to be executed, superimposition of a DC voltage can be advanced. When the photoconductor cleaner 34Y includes the lubricant, the photoconductor drum 31Y is coated with the lubricant. This suppresses the flow of a positive electric change into the photoconductor drum 31Y. Herein, the DC voltage is applied after an AC voltage is discharged to the photoconductor drum 31Y in an area at least from an air gap between a transfer roller 35Y and the photoconductor drum 31Y to an air gap between the charging roller 32Y and the photoconductor drum 31Y. The lubricant used herein can be a natural wax such as carnauba wax and a fatty acid metal salt, such as zinc stearate, or fluororesin, such as polytetrafluoroethylene.

The present disclosure has been described above with reference to specific exemplary embodiments but is not limited thereto. Various modifications and enhancements are possible without departing from the scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

a photoconductor on which an electrostatic latent image is formed by irradiation of the photoconductor with light;

a charge power supply device configured to supply a superimposed voltage of a direct current voltage and an alternating current voltage;

a charger configured to receive the superimposed voltage to charge the photoconductor;

a developing device configured to develop the electrostatic latent image formed on the photoconductor into a toner image;

a transfer device configured to transfer the toner image developed by the developing device to a recording medium; and circuitry configured to determine whether a flow of electric charge from the transfer device into the photoconductor has occurred in an image forming outputting operation, issue a charge removal command in response to a determination that the flow of electric charge from the transfer device into the photoconductor has occurred in the image forming outputting operation, and cause the charge power supply device, in response to the charge removal command, to output only the alternating current voltage as the superimposed voltage to the charger for a predetermined period in a state in which the photoconductor is rotated.

2. The image forming apparatus according to claim 1, wherein the circuitry is further configured to issue the charge removal command when there is an emergency stop in the image forming outputting operation.

3. The image forming apparatus according to claim 1, wherein the circuitry is configured to cause the charge power supply device to output only the alternating current voltage as the superimposed voltage to the charger for the predetermined period when rotation of the photoconductor is resumed after there is an emergency stop in the image forming outputting operation.

4. The image forming apparatus according to claim 1, wherein the circuitry is configured to:

determine an electric current value flowing to the transfer device; and when the determined electric current value is greater than a threshold value determined based on a discharge start voltage and a resistance value of the transfer device, determine that the flow of electric charge from the transfer device into the photoconductor has occurred.

5. The image forming apparatus according to claim 1, wherein the circuitry is configured to:

determine temperature and humidity in the image forming apparatus; and when the determined temperature and humidity in the image forming apparatus exceeds a threshold value defined based on temperature and humidity at which electric charge on the photoconductor leaks, determine that the flow of electric charge from the transfer device into the photoconductor has occurred.

6. The image forming apparatus according to claim 1, wherein the circuitry is configured to:

determine a layer thickness of the photoconductor; and when the determined layer thickness of the photoconductor is less than a threshold thickness after determining that the flow of the electric charge from the transfer device into the photoconductor has occurred, reduce the predetermined period for outputting only the alternating current voltage as the superimposed voltage to the charger.

7. The image forming apparatus according to claim 1, wherein the photoconductor has a surface coated with a fatty acid metal salt, natural wax, or fluororesin.

8. The image forming apparatus according to claim 1, wherein the predetermined period is shorter than a reference period.

9. A method for controlling an image forming apparatus, the method comprising:

charging a photoconductor disposed in the image forming apparatus and on which an electrostatic latent image is formed by irradiation of the photoconductor with light using a charger that receives from a charge power supply device a superimposed voltage of a direct current voltage and an alternating current voltage;

developing the electrostatic latent image formed on the photoconductor into a toner image using a developing device;

transferring the toner image developed by the developing device to a recording medium using a transfer device;

determining, by circuitry of the image forming apparatus, whether a flow of electric charge from the transfer device into the photoconductor has occurred in an image forming outputting operation;

issuing, by the circuitry of the image forming apparatus, a charge removal command in response to a determination that the flow of electric charge from the transfer device into the photoconductor has occurred in an image forming outputting operation; and causing the charge power supply device to output only the alternating current voltage as the superimposed voltage to the charger for a predetermined period in a state in which the photoconductor is rotated, in response to the charge removal command.

* * * * *